United States Patent [19]

Okutsu et al.

[11] Patent Number: 4,569,904

[45] Date of Patent: Feb. 11, 1986

[54] DEVELOPING METHOD

[75] Inventors: Eiich Okutsu; Kazumi Watase; Yoshio Inagaki; Shigeo Hirano, all of Kanagawa, Japan

[73] Assignee: Fuji Photo Film Co., Ltd., Kanagawa, Japan

[21] Appl. No.: 663,924

[22] Filed: Oct. 23, 1984

[30] Foreign Application Priority Data

Oct. 27, 1983 [JP] Japan ..... 58-202000

[51] Int. Cl.[4] ..... G03C 5/24

[52] U.S. Cl. ..... 430/434; 430/265; 430/268; 430/438; 430/446; 430/949

[58] Field of Search ..... 430/268, 265, 949, 434, 430/438, 446

[56] References Cited

U.S. PATENT DOCUMENTS

| | | | |
|---|---|---|---|
| 3,790,383 | 2/1974 | Shimamura et al. | 430/268 |
| 3,793,027 | 2/1974 | Okutsu et al. | 430/268 |
| 4,269,929 | 5/1981 | Nothnagle | 430/268 |
| 4,311,781 | 1/1982 | Mifune et al. | 430/264 |

*Primary Examiner*—Mary F. Downey

*Attorney, Agent, or Firm*—Sughrue, Mion, Zinn, Macpeak and Seas

[57] ABSTRACT

A method for developing an exposed negative silver halide photographic light-sensitive material is described, in the presence of a hydrazind derivative, comprising treating the material with a developer containing at least components (a) a developing agent, (b) not less than 0.25 mol/liter of a sulfite, and (c) not less than 0.1 mol/liter of a compound having an acid dissociation constant of from $1\times10^{-11}$ to $3\times10^{-13}$, and having a pH value of from 10.5 to 12.3.

19 Claims, No Drawings

DEVELOPING METHOD

FIELD OF THE INVENTION

This invention relates to a method for developing a silver halide photographic light-sensitive material, and particularly to a method for developing a silver halide photographic light-sensitive material for photographic printing plate which can stably produce high contrast image suitable for making photographic printing plates.

BACKGROUND OF THE INVENTION

In the production of photographic printing plates, it is necessary to establish a system to form an image having high contrast in order to ensure reproducibility of an image of continuous gradation by dot images or reproducibility of line images.

For this purpose, a special type of developer, generally called a lith developer, has hitherto been employed. The lith developer generally contains only hydroquinone as a developing agent, and also contains, as a preservative, a sulfite in the form of an adduct with formaldehyde at an extremely reduced concentration of free sulfite ions, so as not to inhibit infectious developability of the developing agent. Therefore, the lith developer has a serious disadvantage in that it is susceptible to air oxidation and cannot withstand storage without deterioration over a period of more than 3 days.

Conventional methods for obtaining a photographic property of high contrast by using a stable developer include a method of using a hydrazine derivative as disclosed in U.S. Pat. Nos. 4,166,742, 4,168,977, 4,221,857, 4,224,401, 4,243,739, 4,272,606 and 4,311,781, etc. This method can afford good photographic properties such as high contrast and high sensitivity, and also permits addition of highly concentrated sulfite to a developer, so that the developer has a greatly improved stability against air oxidation as compared with the lith developer.

However, the effects of increasing contrast and sensitivity brought about by the hydrazine derivative are apt to vary with variation of chemical properties of a developer. Therefore, very complicated management has been required in order to attain invariably stable effects and to increase contrast and sensitivity, particularly in the case when the development is conducted using an automatic developing machine. For example, the amount of silver contained per unit surface area of the development-processed light-sensitive material and the blackened ratio should be determined each time a light-sensitive material is processed, and the developer should be replenished accordingly.

SUMMARY OF THE INVENTION

Accordingly, an object of this invention is to provide a developing method for more stably obtaining the desirable effects of hydrazine derivatives to increase contrast and sensitivity.

Another object of this invention is to provide a developing method for stably and rapidly obtaining high contrast and high sensitivity in the presence of hydrazine derivatives by the use of an automatic developing machine irrespective of silver contents or blackened ratio of light-sensitive materials.

These objects of this invention can be accomplished by a method comprising developing a light-exposed silver halide photographic light-sensitive material in the presence of a hydrazine derivative with a developer containing at least components (a) a developing agent, (b) not less than about 0.25 mol/liter of a sulfite preservative and (c) not less than about 0.1 mol/liter of a compound having an acid dissociation constant of from $1\times10^{-11}$ to $3\times10^{-13}$, and having a pH value of from 10.5 to 12.3.

DETAILED DESCRIPTION OF THE INVENTION

The developing agent which can be used in the developer according to the present invention is not particularly limited, but preferably it contains a dihydroxybenzene in view of the ease of obtaining satisfactory dot quality therewith, and more preferably it contains a combination of a dihydroxybenzene and a 1-phenyl-3-pyrazolidone derivative in view of enjoyable developability.

Dihydroxybenzene developing agents that can be used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone, etc., with hydroquinone being particulary preferred.

1-Phenyl-3-pyrazolidone developing agents that can be used in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and the like.

These developing agents are usually used in an amount ranging from about 0.05 mol/liter to about 0.8 mol/liter. In the case of using a combination of a dihydroxybenzene derivative and the 1-phenyl-3-pyrazolidone derivative, it is preferred to use the former in an amount of from 0.05 mol/liter to 0.5 mol/liter liter and the latter in an amount of 0.06 mol/liter or less.

Sulfites which can be used as preservatives in the present invention include sodium sulfite, potassium sulfite, lithium sulfite, ammonium sulfite, sodium bisulfite, potassium metabisulfite, formaldehyde sodium bisulfite, etc. The sulfite is usually used in an amount of about 0.25 mol/liter or more, and preferably 0.3 mol/liter or more, but since addition of too large a quantity of the sulfite leads to contamination of the developer due to precipitation in the developer, it is generally desirable not to exceed 1.2 mol/liter for the amount of sulfite.

The pH value of the developer according to the present invention should be adjusted to a value of from 10.5 to 12.3. The pH adjustment of the developer can be carried out with an alkali, such as water-soluble inorganic alkali metal salts (e.g., sodium hydroxide, sodium carbonate, etc.).

According to the present invention a compound having an acid dissociation constant of from $1\times10^{-11}$ to $3\times10^{-13}$ is incorporated as component (c) in the developer having the above-described composition, in an amount of not less than 0.1 mol/liter, and preferably in an amount of from 0.2 mol/liter to 1 mol/liter, thereby making it possible to stably obtain the effects of hydrazines on increasing contrast and sensitivity, even when an automatic developing machine is used, regardless of the silver content or blackened ratio of the developed light-sensitive material.

The term "acid dissociation constant" herein used indicates an acid dissociation constant of $1\times10^{-11}$ to $3\times10^{-13}$ irrespective of the first, second, third dissociation constants and so on, when the compound has a plurality of pKa values.

The following mechanism is believed to account for the effect of component (c), although the invention is not to be considered to be limited to such mechanism. That is, it is assumed that the amount of acid is variable according to variation of the blackened ratio of a film, but the presence of the compound having an acid dissociation constant of $1\times10^{-11}$ to $3\times10^{-13}$ makes variation of the pH value of a developer small, thereby making variation of the photographic properties small. Specific effects of the component (c) will be described in detail in the Examples hereinafter described.

Preferred examples of component (c) are saccharides, particularly those represented by formulae (I) and (II); oximes, particularly those represented by formula (III); phenols, particularly those represented by formula (IV); and fluorinated alcohols, particularly those represented by formula (V); as described below.

The preferred saccharides are represented by formulae (I) and (II)

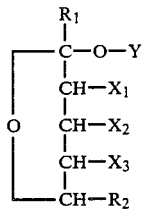

(I)

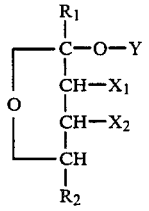

(II)

wherein $X_1$, $X_2$ and $X_3$, which may be the same or different, each represents a hydrogen atom, a hydroxy group, an amino group, a halogen atom, an acyloxy group, an alkoxy group, an acylamino group or a phosphoryloxy group; $R_1$ and $R_2$, which may be the same or different, each represents a hydrogen atom, an alkyl group (e.g., a methyl group), a substituted alkyl group (e.g., a hydroxymethyl group, a 1,2-dihydroxyethyl group, an acetoxymethyl group, a benzoyloxymethyl group, a methoxymethyi group, a benzyloxymethyl group, etc.) or a carboxyl group; Y represents a hydrogen atom, an acyl group, an alkoxycarbonyl group, a carbamoyl group, or an alkyl group; and a 5- or 6-membered ring may be formed by an ether-linkage formation between two hydroxy groups of $X_1$, $X_2$, $X_3$, $R_1$, $R_2$ and Y or by acetyl formation of said two hydroxy groups and a carbonyl compound, e.g., acetone or benzaldehyde.

In the above-described formulae (I) and (II), the Y moiety may form (n-1) glucoside bonds when taken together with hydroxyl groups as represented by $X_1$, $X_2$, $X_3$, $R_1$, $R_2$ and Y of formulae (I) and (II), thereby completing an oligosaccharide composed of n units of the formula (I) or (II), wherein n represents an integer of from 2 to 6.

$X_1$, $X_2$ and $X_3$ more preferably represent a hydrogen atom or a hydroxy group, and very preferably a hydroxy group.

$R_1$ and $R_2$ preferably represent a hydrogen atom, a hydroxymethyl group, a 1,2-dihydroxyethyl group or a carboxyl group, and more preferably a hydrogen atom, a hydroxymethyl group, or a 1,2-dihydroxyethyl group.

Y preferably represents a hydrogen atom.

Specific examples of the saccharides represented by formulae (I) and (II) are shown below:

| Compound No. | Compound Name | Formula |
|---|---|---|
| I-1 | D-Erythrose | (II) |
| I-2 | D-Threose | (II) |
| I-3 | D-Arabinose | (I) |
| I-4 | D-Ribose | (I) |
| I-5 | D-Xylose | (I) |
| I-6 | D-Erythro-pentulose | (II) |
| I-7 | Allose | (I) |
| I-8 | D-Galactose | (I) |
| I-9 | D-Glucose | (I) |
| I-10 | D-Mannose | (I) |
| I-11 | D-Talose | (I) |
| I-12 | β-D-Fructose | (I) |
| I-13 | α-L-Sorbose | (I) |
| I-14 | 6-Deoxy-D-glucose | (I) |
| I-15 | D-Glycero-D-galactoheptose | (I) |
| I-16 | α-D-Allo-heptulose | (I) |
| I-17 | β-D-Altro-3-heptulose | (I) |
| I-18 | Sucrose | (I) |
| I-19 | Lactose | (I) |
| I-20 | D-Maltose | (I) |
| I-21 | Isomaltose | (I) |
| I-22 | Inulobiose | (II) |
| I-23 | Hyalbiouronic acid | (I) |
| I-24 | Maltotriose | (I) |
| I-25 | 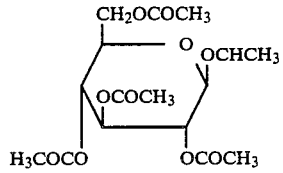 | (I) |
| I-26 | 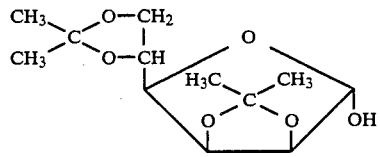 | (II) |

Most of the above-illustrated compounds are commercially produced and readily available. Those commercially unavailable can easily be synthesized based on the descriptions appearing, e.g., in M. Kotake, Ed., "Aliphatic Compounds II", *Dai-Yuki Kagaku,* Vol. 3, Asakura Shoten (1957), and W. Pigman and D. Horton, Eds., "The Carbohydrates", *Chemistry and Biochemistry,* 2nd Ed., IA (1972) and IIA (1970), Academic Press.

The preferred oximes are represented by formula (III)

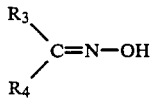

(III)

wherein $R_3$ and $R_4$, which may be the same or different, each represents a hydrogen atom, a substituted or unsubstituted alkyl group, a substituted or unsubstituted aryl group, an acyl group or a heterocyclic ring; or $R_3$ and $R_4$ jointly form a 5- or 6-membered ring, particularly a cycloalkyl ring.

In formula (III), the alkyl group includes a straight or branched chain or cyclic alkyl group having from 1 to 18 carbon atoms. The substituent for the alkyl group includes a hydroxy group, a carboxyl group, an alkoxy group, a halogen atom, a sulfo group, a sulfamoyl group, a carbamoyl group, a sulfonylamino group, an acylamino group, a cyano group, and an acyloxy group. The aryl group as represented by $R_3$ or $R_4$ includes a phenyl group and a naphthyl group, and the substituent therefor are the same as those enumerated for the alkyl group. The heterocyclic ring formed by $R_3$ and $R_4$ includes, for example, thiazole, oxazole, imidazole, triazole, tetrazole, thiadiazole, oxadiazole, tetrahydrofuran, morpholine, pyridine, piperidine, benzothiazole, benzoxazole and benzimidazole rings.

Specific examples of compounds of formula (III) are shown below:

$CH_3CH{=}N{-}OH$ III-1

$n\text{-}C_3H_7{-}CH{=}N{-}OH$ III-2

III-3

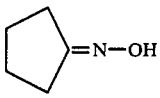

III-4

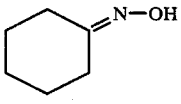

III-5

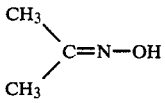

III-6

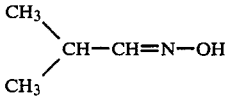

III-7

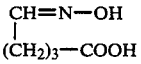

III-8

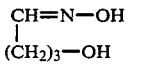

III-9

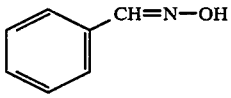

III-10

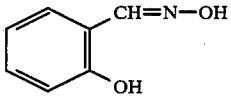

III-11

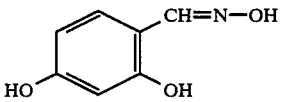

-continued

III-12

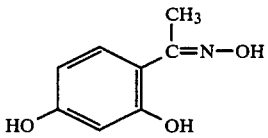

III-13

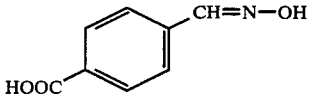

III-14

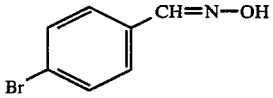

III-15

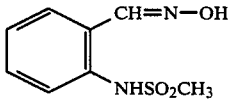

III-16

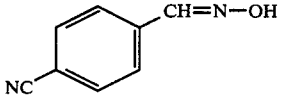

III-17

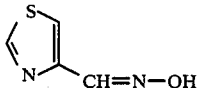

III-18

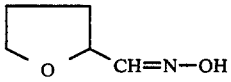

III-19

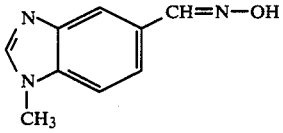

III-20

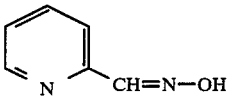

III-21

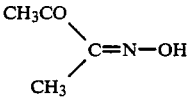

These compounds represented by formula (III) are commercially available or can be synthesized by the process disclosed, e.g., in S. R. Sandler and W. Karo, Eds., *Organic Functional Group Preparations,* Vol. 3, p. 365, Academic Press (1972).

Preferred phenols are represented by formula (IV):

(IV)

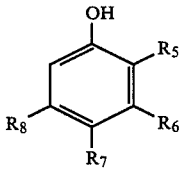

wherein $R_5$, $R_6$, $R_7$ and $R_8$, which may be the same or different, each represents a hydrogen atom, an amino group, a carboxyl group, a sulfonic acid group, a substituted or unsubstituted alkyl group having from 1 to 4 carbon atoms or a substituted or unsubstituted alkoxy group. The substituents for the alkyl or alkoxy group are the same as those enumerated for the alkyl or aryl group as represented by $R_3$ or $R_4$ in formula (III).

Specific examples of the compounds of the formula (IV) are shown below:

IV-1

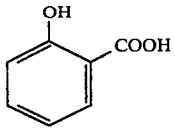

IV-2

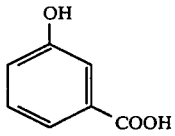

IV-3

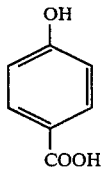

IV-4

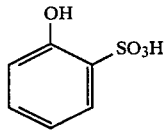

IV-5

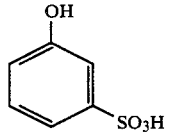

IV-6

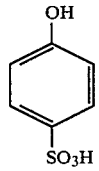

IV-7

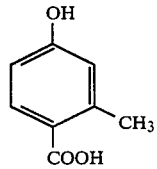

IV-8

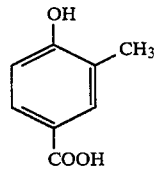

IV-9

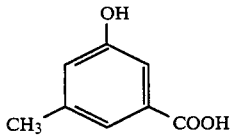

-continued

IV-10

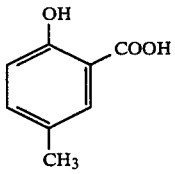

IV-11

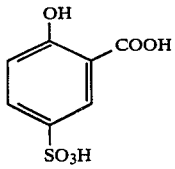

Many of these compounds (IV) are commercially available and others are known per se or can easily be synthesized.

Preferred fluorinated alcohols are represented by formula (V)

(V)

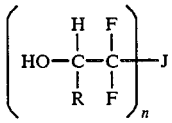

wherein R represents a hydrogen atom, a substituted or unsubstituted alkyl group, a substituted or unsubstituted cycloalkyl group or a substituted or unsubstituted aryl group; n represents 1 or 2; and J represents a hydrogen atom, a fluorine atom, a substituted or unsubstituted alkyl group, a substituted or unsubstituted cycloalkyl group, a substituted or unsubstituted aryl group or a substituted or unsubstituted aralkyl group when n is 1, or J represents a substituted or unsubstituted alkylene group, a substituted or unsubstituted cycloalkyl group, a substituted or unsubstituted arylene group or a substituted or unsubstituted aralkylene group when n is 2.

Preferred compounds represented by formula (V) are those wherein R repesents a hydrogen atom or a fluorine-substituted alkyl group; n represents 1 or 2; and J represents a hydrogen atom, a fluorine atom or a fluorine-substituted alkyl group when n is 1, or a fluorine-substituted alkylene group when n is 2. Of these, those compounds wherein the total carbon atom number is 6 or less per hydrophilic group such as hydroxy group, carboxyl group, and sulfo group, are particularly preferred because they have very satisfactory solubility in processing solutions.

Specific examples of compounds represented by formula (V) are shown below:

$CF_3CH_2OH$ V-1

$CHF_2CF_2CF_2OH$ V-2

$CF_3CH(OH)CF_2Cl$ V-3

$HOCH_2CF_2CF_2CF_2CH_2OH$ V-4

$HOCH_2CF_2CF_2CF_2CF_2CH_2OH$ V-5

$HOC(=O)CH_2CH(OH)CF_3$ V-6

-continued $CHF_2CF_2CF_2CF_2CF_2CH_2OH$ V-7

$CHF_2CF_2CH_2OH$ V-8

Many of these compounds (V) are commercially available and the others are known per se or can easily be synthesized.

Among the compounds of formulae (I) through (V), particularly preferred are the saccharides of formulae (I) and (II), the oximes of formula (III), and the fluorinated alcohols of formula (V), with the saccharides especially producing superior effects.

The developer in accordance with the present invention is characterized by containing (a) a developing agent (preferably a dihydroxybenzene developing agent and 1-phenyl-3-pyrazolidone or a derivative thereof), (b) at least 0.25 mol/liter of a sulfite preservative and (c) a compound having an acid dissociation constant of from $1\times10^{-11}$ to $3\times10^{-13}$ and having a pH value of from 10.5 to 12.3. That is, the developer has a composition as that of commonly employed silver halide photographic developer, as disclosed in, for example, T. H. James, *The Theory of the Photographic Process,* 4th Ed. (1977), pp. 373–436, except for the above characteristics.

Additives which can be used in the developer in addition to the above-described components (a) to (c) include pH-adjusting agents or buffers, e.g., boric acid, borax, sodium hydroxide, potassium hydroxide, sodium carbonate, potassium carbonate, sodium tertiary phosphate, potassium tertiary phosphate, etc.; development inhibitors, e.g., sodium bromide, potassium bromide, potassium iodide, etc.; organic solvents, e.g., ethylene glycol, diethylene glycol, triethylene glycol, dimethylformaldehyde, methyl cellosolve, hexylene glycol, etc.; development accelerators, e.g., alkanolamines (e.g., diethanolamine, triethanolamine, etc.), imidazole and its derivatives, etc.; and antifoggants or black pepper-preventing agents, e.g., mercapto compounds (e.g., 1-phenyl-5-mercaptotetrazole), indazole compounds (e.g., 5-nitroindazole) and benztriazole compounds (e.g., 5-methylbenztriazole). The developer may also contain color-controlling agents, surface active agents, defoaming agents, water-softeners, hardeners and the like, if necessary.

A conventional fixing solution can be used. Examples of fixing agents which can be used include not only thiosulfates and thiocyanates but also organic sulfur compounds known to have a fixing effect. The fixing solution may contain water-soluble aluminium salts as a hardener. In addition, complexes between a trivalent iron compound and ethylenediaminetetraacetic acid can also be used.

Development-processing temperatures are generally selected from the range of from 18° C. to 50° C., and preferably from 25° C. to 43° C.

The developing method of this invention is particularly suitable for rapid processing using an automatic developing machine. A usable automatic developing machine may be of any type such as roller transfer type, belt transfer type and others. The processing time may be short, and sufficient effects can be obtained even in rapid processing taking a total processing time within 2 minutes, particularly within 100 seconds, of which a time period of 15 seconds to 60 seconds is alloted to development.

According to the developing method of the present invention, complicated management of liquids becomes unnecessary and invariably constant photographic properties such as high contrast and high sensitivity can always be obtained simply by replenishing the developer according to the surface area of light-sensitive materials to be processed.

In the developing method of this invention, in addition to hydrazine sulfate, hydrazine hydrochloride, etc., there can also be used hydrazine derivatives represented by formula (VI).

$$R^1—NHNH—G—R^2 \quad (VI)$$

wherein $R^1$ represents an aliphatic or aromatic group; $R^2$ represents a hydrogen atom, a substituted or unsubstituted alkyl group, a substituted or unsubstituted aryl group, a substituted or unsubstituted alkoxy group or a substituted or unsubstituted aryloxy group; and G represents a carbonyl group, a sulfonyl group, a sulfoxy group, a phosphoryl group, or an N-substituted or unsubstituted imino group.

In the above-described formula (VI), the aliphatic group as represented by $R^1$ preferably contains from 1 to 30 carbon atoms, and more preferably is a substituted or unsubstituted, straight chain, branched chain or cyclic alkyl group having from 4 to 20 carbon atoms. The branched chain alkyl group may be cyclized to form a saturated heterocyclic ring containing one or more hetero atoms. The substitutent for the alkyl group includes an aryl group, an alkoxy group, a sulfonamido group, a carbonamido group, etc. Examples of such an aliphatic group include a t-butyl, group, an n-dodecyl group, a t-octyl group, a cyclohexyl group, a pyrrolidyl group, an imidazolyl group, a tetrahydrofuryl group, a morpholino group, and the like.

In formula (VI), the aromatic group as represented by $R^1$ is a substituted or unsubstituted, mono- or dicyclic aryl group or a substituted or unsubstituted unsaturated heterocyclic group. The unsaturated heterocyclic group may form a heteroaryl group when condensed with a mono- or dicyclic aryl group. For example, the aromatic group includes a benzene ring, a naphthalene ring, a pyridine ring, a pyrimidine ring, an imidazole ring, a pyrazole ring, a quinoline ring, an isoquinoline ring, a benzimidazole ring, an indazole ring, a thiazole ring, a benzothiazole ring, etc., with a benzene ring being preferred.

In particular, $R^1$ preferably represents a substituted or unsubstituted aryl group.

Preferred substituents for the aryl group or unsaturated heterocyclic group include a straight, branched or cyclic alkyl group, preferably one having from 1 to 20 carbon atoms (e.g., methyl, ethyl, isopropyl, n-dodecyl, etc.); an aralkyl group, preferably a mono- or dicyclic aralkyl group having 1 to 3 carbon atoms in its alkyl moiety (e.g., benzyl); an alkoxy group, preferably having from 1 to 20 carbon atoms (e.g., methoxy, ethoxy, etc.); a substituted amino group, preferably substituted with an alkyl group having from 1 to 20 carbon atoms (e.g., dimethylamino, diethylamino, etc.); an aliphatic acylamino group, preferably containing an alkyl group having from 2 to 21 carbon atoms (e.g., acetylamino, heptylamino, etc.); an aromatic acylamino group, preferably having a mono- or dicyclic aryl group (e.g., benzoylamino); and a group $$X—Y)_n$$

wherein n represents 0 or 1; X represents a group having a unit of $$-\overset{\overset{\displaystyle S}{\|}}{C}-NH-,$$

a group having a unit of $$-\overset{\overset{\displaystyle O}{\|}}{C}-NH-,$$

a group of $$\begin{array}{l} Z \quad C{=}N-, \\ \quad\ \ \diagup \\ \quad\ \ N \\ \quad\ \ \ |\ \ \ \\ \quad\ \ R^{31} \end{array}$$

a heterocyclic ring residue, an aralkyl group (when n=1) or an alkyl-substituted aryl group, wherein $R^{31}$ represents a hydrogen atom or a substituted or unsubstituted, saturated or unsaturated aliphatic group (e.g., an alkyl group, an alkenyl group and an alkynyl group) and Z represents a non-metallic atomic group and forms, when taken together with $$-\overset{\overset{\displaystyle R^{31}}{|}}{\overset{\|}{C}-N}-,$$

a 5- or 6-membered hetero ring; and Y represents a divalent linking group, such as —CONH—, —$R^{11}$—CONH—, —O—$R^{11}$—CONH—, —S—$R^{11}$—CONH—, —$R^{11}$—, —$R^{11}$—O—$R^{12}$—, —$R^{11}$—S—$R^{12}$—, —$SO_2NH$—, —$R^{11}$—$SO_2NH$—, —NHCONH—, —$CH_2$—CH—N—, —$R^{11}$—NH—, —$R^{11}$—O—$R^{12}$—CONH—, —NHCO—$R^{11}$—, —NHCO—$R^{11}$—CONH—, —$R^{11}$—$R^{12}$— and the like, wherein $R^{11}$ and $R^{12}$, which may be the same or different from each other, each represents a divalent saturated or unsaturated aliphatic group (e.g., ethylene, butenylene, 1-methylpropylene, 1-methylmethylene, etc.) or a divalent substituted or unsubstituted aromatic group, wherein the substituent is an amino group, etc. (e.g., phenylene, naphthylene, 5-amino-1,2-phenylene, etc.), with the proviso that $R^{11}$ and $R^{12}$ in —$R^{11}$—$R^{12}$— bond are different from each other.

In the above definition for X, the expression "heterocyclic ring residue" means a group (residue) of a 5- or 6-membered ring containing at least one hetero (non-carbon) atom, and the residue may be condensed with an aromatic ring, preferably a benzene ring. Preferred examples of such a heterocyclic ring residue include a monovalent group derived from a heterocyclic compound (e.g., 1,2-benztriazol-5-yl, 5-tetrazoyl, indazol-3-yl, 1,3-benzimidazol-5-yl, hydroxytetrazainden-2- or -3-yl, etc.), a monovalent group derived from a heterocyclic quaternary ammonium salt (e.g., N-ethylbenzthiazolinium-2-yl, N-sulfoethyl-benzthiazolinium-2-yl, N,N-dimethylbenzimidazolinium-2-yl, etc.) and a monovalent group derived from a heterocyclic compound having a mercapto group (e.g., 2-mercaptobenzthiazol-5- or -6-yl, 2-mercaptobenzoxazol-5- or -6-yl, etc.).

The aralkyl group as represented by X refers to a mono- or dicyclic aralkyl group having from 1 to 3 carbon atoms in its alkyl moiety, e.g., a benzyl group.

The alkyl-substituted aryl group as represented by X includes a 2,4-di-t-amyl-1-phenyl group.

The group having a unit of $$-\overset{\overset{\displaystyle S}{\|}}{C}-NH-$$

preferably includes a group of $$R^{21}-\overset{\overset{\displaystyle S}{\|}}{C}-NH-,$$

a group of $$R^{21}-S-\overset{\overset{\displaystyle O}{\|}}{C}-NH-,$$

a group of $$R^{21}-\overset{\overset{\displaystyle R^{22}}{|}}{N}-\overset{\overset{\displaystyle S}{\|}}{C}-\overset{\overset{\displaystyle R^{23}}{|}}{N}-,$$

a group of $$R^{21}-R^{11}-NH\overset{\overset{\displaystyle S}{\|}}{C}-NH-,$$

etc.; and the group having a unit of $$-\overset{\overset{\displaystyle O}{\|}}{C}-NH-$$

preferably is a group of $$R^{21}-\overset{\overset{\displaystyle O}{\|}}{C}-NH-,$$

a group of $$R^{21}-\overset{\overset{\displaystyle R^{22}}{|}}{N}-\overset{\overset{\displaystyle S}{\|}}{C}-\overset{\overset{\displaystyle R^{23}}{|}}{N}-,$$

etc., wherein $R^{11}$ is as defined above; $R^{21}$ represents a substituted or unsubstituted aliphatic group (e.g., an alkyl group, a cycloalkyl group, an alkenyl group), a substituted or unsubstituted aromatic group (e.g., phenyl, naphthyl) or a substituted or unsubstituted heterocyclic ring residue (e.g., thiazolyl, benzthiazolyl, imidazolyl, thiazolinyl, pyridinyl, tetrazolyl, etc.); $R^{22}$ represents a hydrogen atom or the same aliphatic or aromatic (substituted or unsubstituted) group as described for $R^{21}$; or $R^{21}$ and $R^{22}$ are taken together to jointly form a ring; and $R^{23}$ represents a hydrogen atom or the same aliphatic group as described for $R^{21}$; with the proviso that at least one of $R^{22}$ and $R^{23}$ is a hydrogen atom.

The substituents for $R^{21}$ or $R^{22}$ include an alkoxy group, an alkoxycarbonyl group, an aryl group, an alkyl group, a dialkylamino group, an alkylthio group, a mercapto group, a hydroxy group, a halogen atom, a carboxyl group, a nitro group, a cyano group, a sulfonyl group, a carbamoyl group, etc.

The ring formed by $R^{21}$ and $R^{23}$ preferably includes

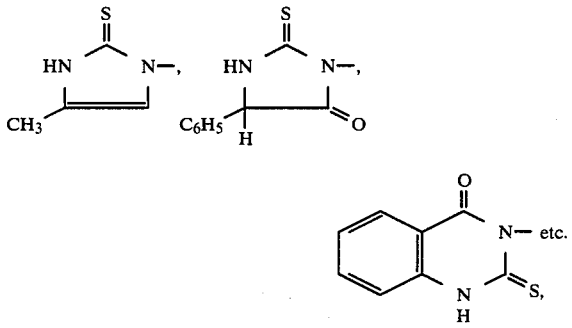

The heterocyclic ring as represented by

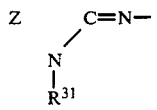

includes a thiazoline ring, a benzthiazoline ring, a naphthothiazoline ring, a thiazolidine ring, an oxazoline ring, a benzoxazoline ring, an oxazolidine ring, a selenazoline ring, a benzselenazoline ring, an imidazoline ring, a benzimidazoline ring, a tetrazoline ring, a triazoline ring, a thiadiazoline ring, a 1,2-dihydropyridine ring, a 1,2-dihydroquinoline ring, a 1,2,3,4-tetrahydroquinoline ring, a perhydro-1,3-thiazine ring, a 2,4-benz[d]thiazine ring, a uracil ring, and the like.

The substituent for the saturated or unsaturated aliphatic group as represented by $R^{31}$ includes an alkoxy group, an alkylthio group, an acylamino group, an acyloxy group, a mercapto group, a sulfo group, a carboxyl group, a hydroxy group, a halogen atom, an amino group, etc.

Of the groups represented by X, those preferred are a group having a unit of

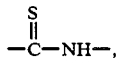

a group of

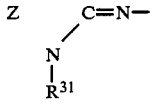

and an alkyl-substituted aryl group (particularly when Y is —O—$R^{11}$—CONH—).

In the formula (VI), the substituted or unsubstituted aryl group as represented by $R^2$ is a mono- or dicyclic aryl group and contains, for example, a benzene ring, a naphthalene ring, etc., particularly a benzene ring. The substituent for the aryl group includes a halogen atom, a cyano group, a carboxyl group, a sulfo group, etc. Preferred examples of the aryl group as represented by $R^2$ are phenyl, 4-chlorophenyl, 4-bromophenyl, 3-chlorophenyl, 4-cyanophenyl, 4-carboxyphenyl, 4-sulfophenyl, 3,5-dichlorophenyl, 2,5-dichlorophenyl, etc.

In formula (VI), the substituted or unsubstituted alkyl group represented by $R^2$ preferably contains from 1 to 4 carbon atoms. Substituents for the alkyl group include a halogen atom, a cyano group, a carboxyl group, a sulfo group, an alkoxy group, a phenyl group, etc. Examples of particularly preferred alkyl group are methyl, ethyl, n-propyl, isopropyl, methoxyethyl, and 2-carboxyethyl groups.

The substituted or unsubstituted alkoxy group as represented by $R^2$ contains from 1 to 8 carbon atoms. The substituent therefor includes a halogen atom, an aryl group, etc. Specific examples of the alkoxy group are methoxy, ethoxy, n-propoxy, isopropoxy, butoxy, isobutoxy, pentachlorobenzyloxy and hexyloxy groups.

The substituted or unsubstituted aryloxy group as represented by $R^2$ is preferably monocyclic. The substituent therefor includes a halogen atom. Examples of the aryloxy group are phenoxy and 4-chlorophenoxy groups.

Of the groups represented by $R^2$, when G represents a carbonyl group, those preferred are a hydrogen atom, a methyl group, a methoxy group, an ethoxy group and a substituted or unsubstituted phenyl group, with a hydrogen atom being particularly preferred. When G is a sulfonyl group, a methyl group, an ethyl group, a phenyl group and a 4-methylphenyl group are preferred, with a methyl group being particularly preferred. When G is a phosphoryl group, a methoxy group, an ethoxy group, a butoxy group, a phenoxy group and a phenyl group are preferred, with a phenoxy group being particularly preferred. When G is a sulfoxy group, a cyanobenzyl group, a methylthiobenzyl group, etc., are preferred. Further, when G is an N-substituted or unsubstituted imino group, a methyl group, an ethyl group and a substituted or unsubstituted phenyl group are preferred, with a methyl group being particularly preferred.

Of the groups represented by G, a carbonyl group is the most preferred.

Preferred examples of the compounds represented by formula (VI) are described in Japanese Patent Application (OPI) Nos. 10921/78, 20922/78, 66732/78, 125602/78, 82/79 and 20318/78 (the term "OPI" as used herein refers to a "published unexamined Japanese patent application"), *Research Disclosure,* 17626, No. 176 (1978), etc. Among them, particularly preferred compounds are those described in Japanese Patent Application (OPI) Nos. 10921/78, 20922/78 and 66732/78.

Specific examples of the compounds represented by formula (VI) are shown below, but the present invention is not limited thereto:

VI-1

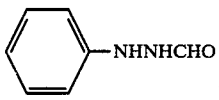

VI-2

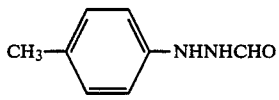

-continued
VI-3
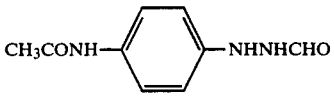
VI-4
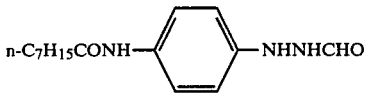
VI-5
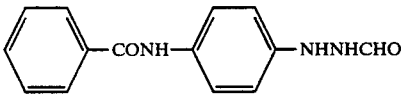
VI-6
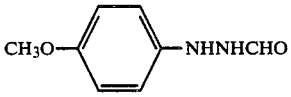
VI-7
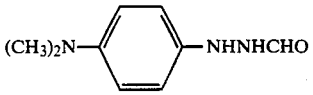
VI-8
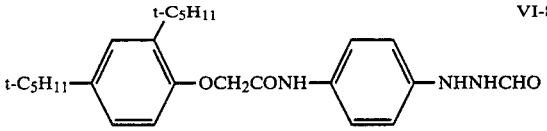
VI-9
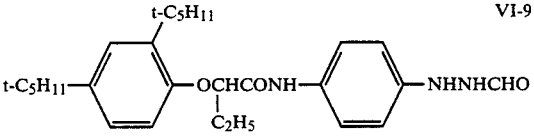
VI-10
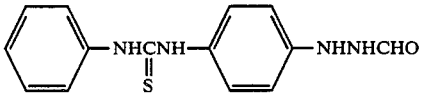
VI-11
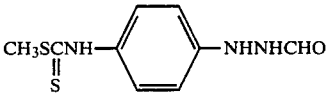
VI-12
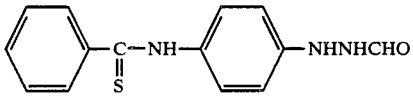
VI-13
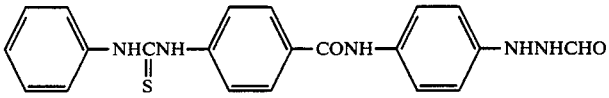
VI-14
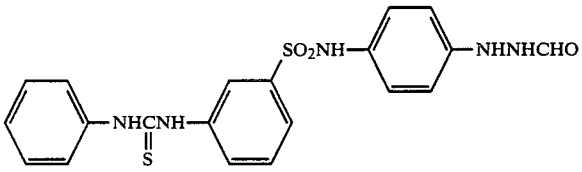
VI-15
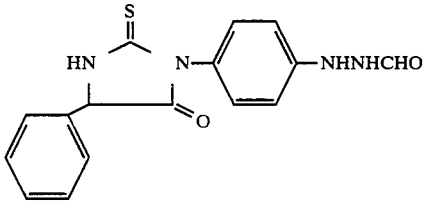
VI-16
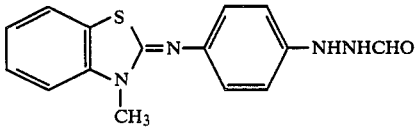
VI-17
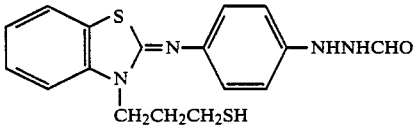
VI-18
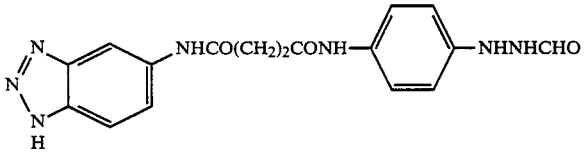
VI-19
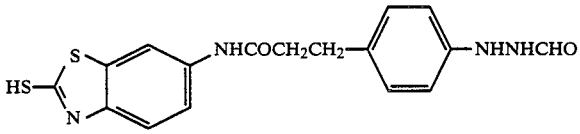

-continued
VI-20
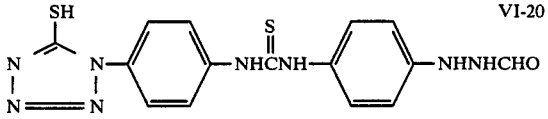
VI-21
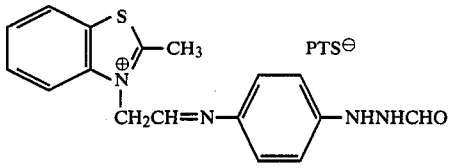
VI-22
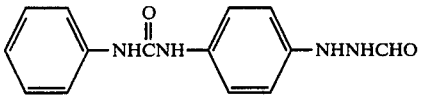
VI-23
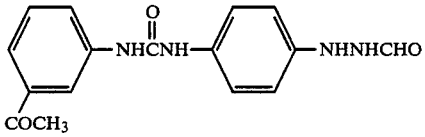
VI-24
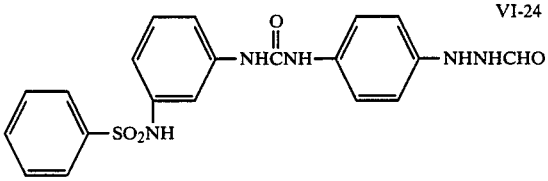
VI-25
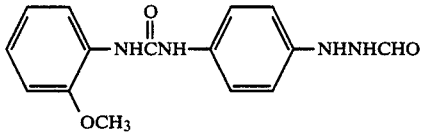
VI-26
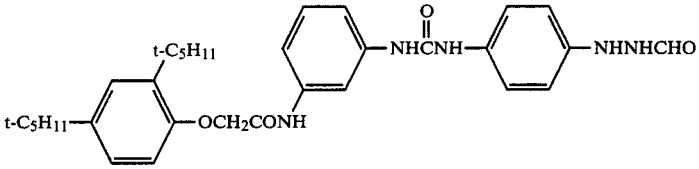
VI-27
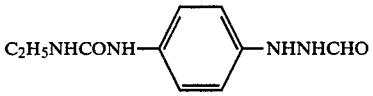
VI-28
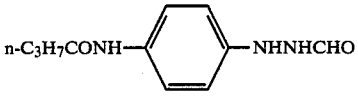
VI-29
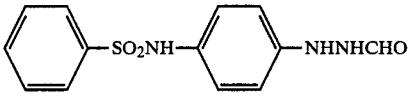
VI-30
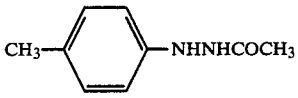
VI-31
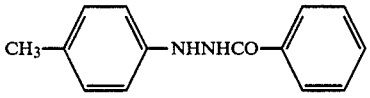
VI-32
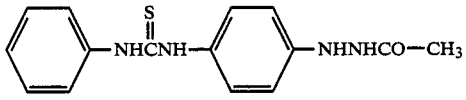
VI-33
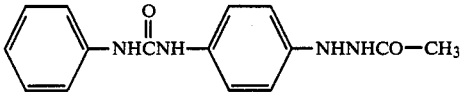
VI-34
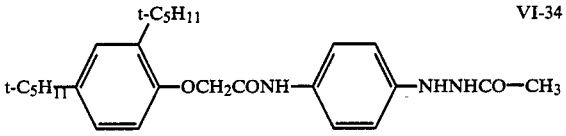
VI-35
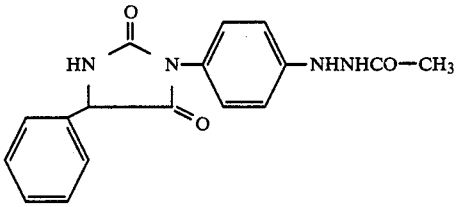
VI-36
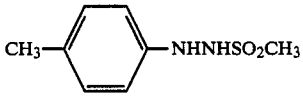
VI-37
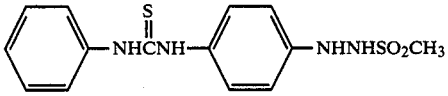
VI-38
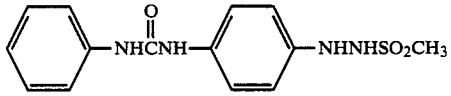

-continued
VI-39
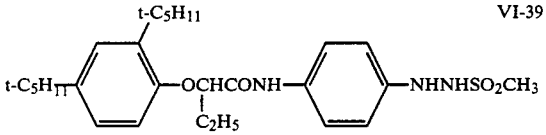
VI-40
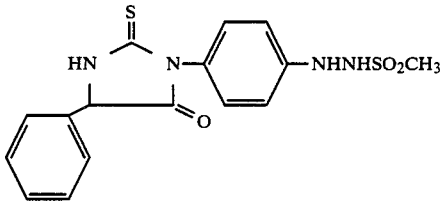
VI-41
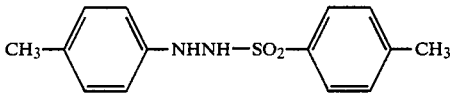
VI-42
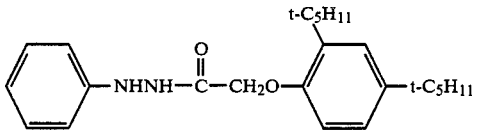
VI-43
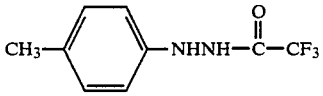
VI-44
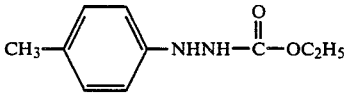
VI-45
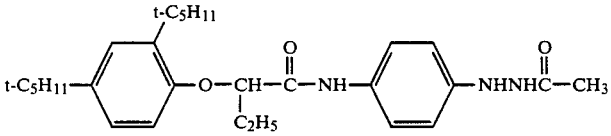
VI-46
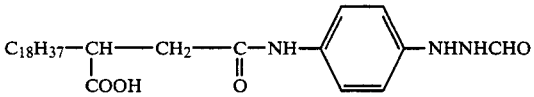
VI-47
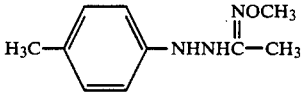
VI-48
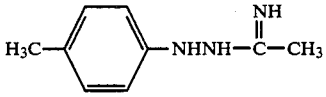
VI-49
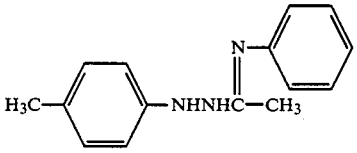
VI-50
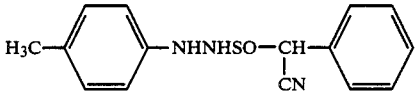
VI-51
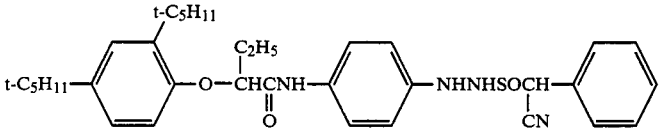
VI-52
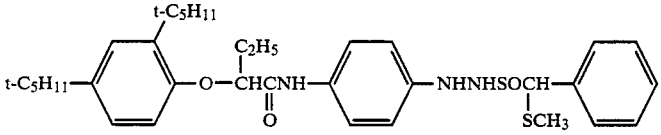
VI-53
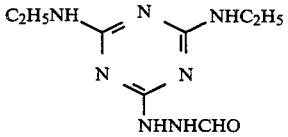
VI-54
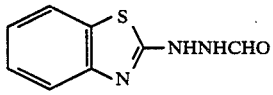

-continued

VI-55

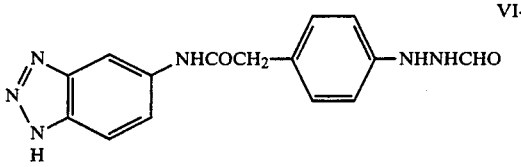

VI-56

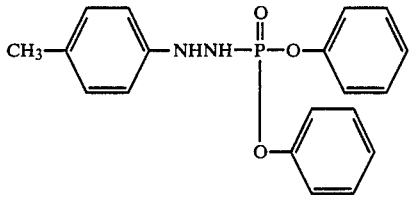

VI-57

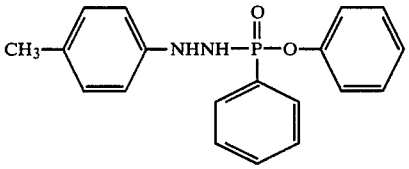

VI-58 $n\text{-}C_{12}H_{25}—NHNHCHO$

VI-59

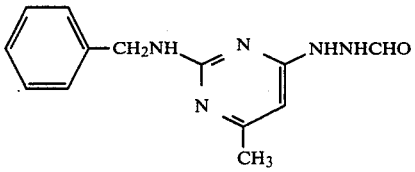

VI-60

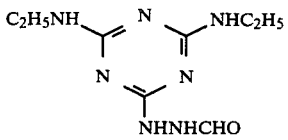

VI-61

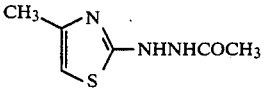

Methods for synthesis of these compounds are disclosed in U.S. Pat. Nos. 4,168,977 and 4,224,401.

These hydrazine compounds may be added to a developing solution or may be incorporated into an emulsion layer or a hydrophilic colloidal layer which is adjacent to the emulsion layer of the light-sensitive material. When the hydrazine compound is added to the developing solution, it can be used in an amount of from about 5 mg to about 5 g per liter of the developing solution, and, when the hydrazine compound is added to the light-sensitive material, it can be used in an amount of from $1\times10^{-6}$ to about $5\times10^{-2}$ mol, preferably from $1\times10^{-5}$ to $2\times10^{-2}$ mol, per mol of silver of the silver halide emulsion layer.

In the present invention, the compound represented by the formula (VI) can be incorporated into a hydrophilic colloidal solution of photographic light-sensitive material in a form of a solution of the compound (VI) in a water-miscible organic solvent such as an alcohol, e.g., methanol or ethanol, an ester, e.g., ethyl acetate, or a ketone, e.g., acetone, or in a form of an aqueous solution in case when it is water-soluble.

Incorporation of the compound (VI) to a photographic emulsion may be carried out at any time between the start of chemical ripening and coating, but is preferably incorporated after completion of chemical ripening.

The silver halide photographic light-sensitive materials to which the developing method of the present invention can be applied will be described below.

Silver halides which can be present in the photographic light-sensitive materials are conventional and include silver chloride, silver chlorobromide, silver iodobromide, silver iodochlorobromide, etc. It is preferable that the silver halide comprises 40 mol% or more, and very preferably 70 mol% or more, of silver chloride.

The content of silver iodide is preferably not more than 5 mol%, and more preferably not more than 1 mol%.

Methods for reacting a water-soluble silver salt with a water-soluble halide include a single jet method, a double jet method and a combination thereof. A method in which silver halide grains are produced in the presence of excess silver ions (the so-called reverse mixing method) can also be used. As one mode of the double jet method, a so-called controlled double jet method, in which the pAg of the liquid phase wherein silver halide grains are to be produced is maintained constant, may be employed. According to the controlled double jet method, silver halide emulsions in which silver halide grains have a regular crystal form and an almost uniform size can be obtained.

Formation of silver halide grains is preferably carried out under an acidic condition. Experiments performed by the present inventors revealed that the effect of the present invention are reduced if the formation of silver halide grains is conducted under a neutral or alkaline condition. A preferred pH range to be employed for formation of grains is 6 or less, and more preferably is 5 or less.

Silver halide grains in the photographic emulsions used in the present invention can have a relatively broad size distribution, but it is preferable that the grains have a narrow size distribution. In particular, it is preferable that more than 90% of the weight or number of total silver halide grains is included in the size range within ±40% of the mean grain size. Silver halide emulsions having such a size distribution are generally called mono-dispersed emulsions.

Silver halide grains used in the present invention preferably have a fine grain size, e.g., 0.7μ or less, and more preferably 0.4μ or less.

Silver halide grains in the photographic emulsions may have a regular crystal form such as a cubic form, an octahedron form and the like, an irregular crystal form such as a spherical form, a plate form, and the like, or a composite form thereof. The grains may also be a mixture of various kinds of crystal forms.

The individual silver halide grain may be homogeneous or comprise a core and an outer shell.

Two or more kinds of silver halide emulsions that are prepared separately may be used as a mixture.

Formation of silver halide grains or physical ripening of the grains may be carried out in the presence of a cadmium salt, a zinc salt, a lead salt, a thallium salt, iridium salt or a complex thereof, a rhodium salt or a complex thereof, an iron salt or a complex thereof, etc. Use of a rhodium salt or a complex thereof is particularly preferred to produce an effect to further ensure compatibility to rapid processing. Usable rhodium salts typically include rhodium chloride, rhodium trichloride, rhodium ammonium chloride, etc. Complexes of these rhodium salts can also be used. The rhodium salt may be added at any time before completion of the first ripening, but desirably is added in the course of grain formation. The amount of the rhodium salt added generally ranges from $1\times10^{-8}$ to $8\times10^{-6}$ mol, and preferably from $1\times10^{-7}$ to $5\times10^{-6}$ mol, per mol of silver.

Addition of rhodium salts to silver halide emulsions brings about not only an increase in contrast, but also a reduction in sensitivity. However, sensitivity can be restored, and at the same time, contrast can be markedly improved, by virtue of the compound of formula (VI).

As binders or protective colloids to be used in preparing photographic emulsions, conventional gelatin can be advantageously used. Other natural or synthetic hydrophilic colloids may also be used. Usable gelatin includes not only lime-processed gelatin, but also acid-processed gelatin and, in addition, hydrolysis products and enzymatic decomposition products of gelatin.

Soluble salts are usually removed from the silver halide emulsions after the precipitation of silver halide grains or after physical ripening. Removal of the soluble salts can be effected by the conventionally known noodle washing method comprising gelling the gelatin or a sedimentation (or flocculation) method using an inorganic salt composed of polyvalent anions (e.g., sodium sulfate), an anionic surface active agent, an anionic polymer (e.g., polystyrenesulfonic acid) or a gelatin derivative (e.g., acylated gelatin, carbamoylated gelatin, etc.). The removal of soluble salts may be omitted.

It is usually preferable that the silver halide emulsion be chemically sensitized. Chemical sensitization of the silver halide emulsion can be effected by sulfur sensitization, reduction sensitization, or noble metal sensitization, or a combination thereof. Such sensitization methods are described, e.g., in H. Frieser, *Die Grundlagen der Photographischen Prozesse mit Silberhalogeniden,* Akademische Verlagsgesellschaft (1968), pp. 675–734.

More specifically, sulfur sensitizing agents used in sulfur sensitization include sulfur compounds contained in gelatin and various other sulfur compounds such as thiosulfates, thioureas, thiazoles, rhodanines, etc. Specific examples of the sulfur sensitizing agents are those described in U.S. Pat. Nos. 1,574,944, 2,278,947, 2,410,689, 2,728,668, 3,501,313 and 3,656,955.

Reduction sensitizing agents used in reduction sensitization include stannous salts, amines, formamidinesulfinic acid, silane compounds, etc., and specifically described in U.S. Pat. Nos. 2,487,850, 2,518,698, 2,983,609, 2,983,610 and 2,694,637.

Noble metal sensitization typically includes gold sensitization using gold compounds, mostly gold complexes. Noble metal other than gold, such as complexes of platinum, palladium, iridium, etc., may also be used. Specific examples of these noble metal compounds are described in U.S. Pat. No. 2,448,060 and British Pat. No. 618,061.

Photographic light-sensitive materials according to the present invention can contain various compounds for the purposes of preventing fog in preparation, during storage, or during photographic processing, or for stabilizing photographic properties. For example, such antifoggants or stabilizers include azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), etc.; mercaptopyramidines; mercaptotriazines; thioketo compounds such as oxazolinethione; azaindenes such as triazaindenes, tetraazaindenes (particularly 4-hydroxy-substituted (1,3,3a,7)tetraazaindenes), pentaazaindenes; benzenethiosulfonic acid amide; and the like. Of these, benzotriazoles (e.g., 5-methylbenzotriazole) and nitroindazoles (e.g., 5-nitroindazole) are particularly preferred. These compounds may be incorporated into a processing solution.

The light-sensitive material which can be used in the present invention can contain sensitizing dyes disclosed in Japanese Patent Application (OPI) No. 52050/80, pp. 45–53 (e.g., cyanine dyes, merocyanine dyes or mixtures thereof), supersensitizing dyes (e.g., aminostilbene compounds, aromatic organic acid-formaldehyde condensates, cadmium salts, azaindene compounds), water-soluble dyes (e.g., oxonol dyes, hemioxonol dyes, merocyanine dyes) as filters or for preventing irradiation, hardeners (e.g., chromium salts, aldehydes, N-methylol compounds, active halogen compounds), and surface active agents (e.g., various known nonionic, anionic, cationic or amphoteric surface active agents, particularly polyoxyalkylenes as described in U.S. Pat. No. 4,221,857.

The polyoxyalkylene oxides or derivatives thereof which can be used in the present invention with advantage have a molecular weight of at least 600. The polyalkylene oxide or their derivatives may be incorporated into either a silver halide light-sensitive material or a developer.

The polyalkylene oxide which can be used in the present invention includes a condensation product between a polyalkylene oxide comprising at least 10 units of an alkylene oxide having from 2 to 4 carbon atoms (e.g., ethylene oxide, propylene-1,2-oxide, butylene-1,2-oxide, etc., preferably ethylene oxide) and a compound having at least one active hydrogen atom (e.g., water, aliphatic alcohols, aromatic alcohols, fatty acids, organic amines, hexitol derivatives, etc.), and a block copolymer comprising two or more polyalkylene oxide units.

More specifically, examples of usable polyalkylene oxide compounds include polyalkylene glycols, polyalkylene glycol alkyl ethers, polyalkylene glycol aryl ethers, polyalkylene glycol alkylaryl ethers, polyalkylene glycol esters, polyalkylene glycol fatty acid amides, polyalkylene glycol amines, polyalkylene glycol block copolymers, polyalkylene glycol graft copolymers and the like.

The polyalkylene oxide compounds may contain one or more polyalkylene oxide chains in their molecule. In case of containing two or more polyalkylene oxide chains in one molecule, individual polyalkylene oxide chain may comprise 10 or less alkylene oxide units, but the total number of alkylene oxide units in one molecule should be at least 10. When one molecule has two or more polyalkylene oxide chains, each of the chains may comprise different alkylene oxide units, e.g., ethylene oxide and propylene oxide. The polyalkylene oxide compounds which can be used in the present invention preferably contain from 14 to 100 alkylene oxide units.

The light-sensitive materials used in this invention can contain a dispersion of a water-insoluble or sparingly soluble synthetic polymer for the purpose of improving dimensional stability and the like. Specific examples of such a polymer include those comprising an alkyl(meth)acrylate, an alkoxyalkyl(meth)acrylate, glycidyl(meth)acrylate, (meth)acrylamide, a vinyl ester (e.g., vinyl acetate), acrylonitrile, an olefin, styrene, etc., or a combination thereof as a monomer, or copolymers comprising the above-described monomers and acrylic acid, methacrylic acid, an $\alpha,\beta$-unsaturated dicarboxylic acid, a hydroxyalkyl(meth)acrylate, a sulfoalkyl(meth)acrylate, styrenesulfonic acid, etc., or a combination thereof as comonomers. More specifically, such polymers are described, for example, in U.S. Pat. Nos. 2,376,005, 2,739,137, 2,853,457, 3,062,674, 3,411,911, 3,488,708, 3,525,620, 3,607,290, 3,635,715 and 3,645,740, and Brirish Pat. Nos. 1,186,699 and 1,307,373.

High contrast emulsions in accordance with the present invention are also suitable for reproduction of line images. For such an application, dimensional stability is an important factor and, therefore, incorporation of the above-described polymer dispersions to the emulsions is desirable.

The present invention will now be illustrated in greater detail with reference to Example 1, for illustrative purposes, but not for limitation.

EXAMPLE 1

A silver chlorobromide emulsion having a grain size of 0.3 $\mu$m and containing rhodium was prepared. After removing soluble salts by a flocculation method, sodium thiosulfate and potassium chlorooleate were added to the emulsion to effect chemical ripening. The resulting emulsion contained 70 mol% silver chloride, 30 mol% silver bromide, and $5\times10^{-6}$ mol of rhodium per mol of silver. To the emulsion was added $1\times10^{-3}$ mol of Hydrazine Derivative VI-8 per mol of silver, and there were further added 3-ethyl-5-[2-(3-ethyl-2(3H)-thiazolinidene-ethylidene]rhodanine as a sensitizing dye, 5-methylbenzotriazole, 4-hydroxy-6-methyl-1,3,3a,7-tetraazaindene, a dispersion of polyethyl acrylate and 2-hydroxy-4,6-dichloro-1,3,5-triazine sodium salt. The thus prepared emulsion was coated on a cellulose triacetate film in an amount of 4 g/m$^2$ as silver.

The film was exposed to light through a wedge for sensitometry using a 150-line magenta contact screen and then developed in a developer having the following composition at 38° C. for 20 seconds, fixed, rinsed and dried. The above developer, as a fresh solution, was tested for photographic properties using an automatic developing machine FG 660F manufactured by Fuji Photo Film Co., Ltd. Then, the above-prepared test film was entirely exposed to light and 200 sheets of the thus exposed large-sized film (50.8 cm$\times$61.0 cm) were subjected to development. The developer after the development of 200 films was tested for photographic properties in the same manner as effected on the fresh developer. The results obtained are shown in Table 1.

Developer A

| | |
|---|---|
| Hydroquinone | 40.0 g |
| 4-Hydroxymethyl-4-methyl-1-phenyl-3-pyrazolidone | 0.4 g |
| Sodium Sulfite | 75.0 g |
| Sodium Hydrogencarbonate | 7.0 g |
| Disodium Ethylenediaminetetraacetate | 1.0 g |
| Potassium Bromide | 3.5 g |
| 5-Methylbenzotriazole | 0.8 g |
| Water to make | 1 liter |
| Adjusted to a pH of 12.0 with potassium hydroxide | |

Developer B

Developer B was the same composition as Developer A, except further containing 103 g/liter (0.3M/liter) of Sucrose I-18 and being adjusted to a pH of 12.0 with additional potassium hydroxide.

Developer C

Developer C was the same composition as Developer A, except further containing 54 g/liter (0.3M/liter) of D-glucose, Compound I-9, and being adjusted to a pH of 12.0 with an additional amount of potassium hydroxide.

Developer D

Developer D was the same composition as Developer A, except additionally containing 54 g/liter (0.3M/liter) of galactose, Compound I-8, and being adjusted to a pH of 12.0 with an additional amount of potassium hydroxide.

Developer E

Developer E was the same composition as Developer A, except additionally containing 90 g/liter (0.3M/liter) of D-xylose, Compound I-5, and being adjusted to a pH of 12.0 with an additional amount of potassium hydroxide.

Developer F

Developer F was the same composition as Developer A, except additionally containing 54 g/liter (0.3M/liter) of fructose, Compound I-12, and being adjusted to a pH of 12.0 with an additional amount of potassium hydroxide.

Developer G

Developer G was the same composition as Developer A, except additionally containing 54 g/liter (0.3M/liter) of mannose, Compound I-10, and being adjusted to a pH of 12.0 with an additional amount of potassium hydroxide.

Developer H

Developer H was the same composition as Developer A, except further containing 41 g/liter (0.3M/liter) of salicylic acid, Compound IV-1, and being adjusted to a pH of 12.0 with an additional amount of potassium hydroxide.

Developer J

Developer J was the same composition as Developer A, except additionally containing 40 g/liter (0.3M/liter) of a fluorinated alcohol, Compound V-8, and being adjusted to a pH of 12.0 with an additional amount of potassium hydroxide.

Developer K

Developer K was the same composition as Developer A, except additionally containing 22 g/liter (0.3M/liter) of acetoxime, Compound III-5, and being adjusted to a pH of 12.0 with an additional amount of potassium hydroxide.

Developer L

Develoepr L was the same composition as Developer A, except additionally containing 65 g/liter (0.3M/liter) of 5-sulfosalicylic acid, Compound IV-11, and being adjusted to a pH of 12.0 with an additional amount of potassium hydroxide.

TABLE 1

| Developer | Fresh Developer Sensitivity* | Fresh Developer Dot** Quality | Exhausted Developer Sensitivity* | Exhausted Developer Dot** Quality |
|---|---|---|---|---|
| A (Comparison) | 100 | 5 | 70 | 2 |
| B (Invention) | 100 | 5 | 95 | 5 |
| C (Invention) | 100 | 5 | 95 | 5 |
| D (Invention) | 100 | 5 | 95 | 5 |
| E (Invention) | 100 | 5 | 95 | 5 |
| F (Invention) | 100 | 5 | 95 | 5 |
| G (Invention) | 100 | 5 | 90 | 4 |
| H (Invention) | 100 | 5 | 85 | 4 |
| J (Invention) | 100 | 5 | 95 | 5 |
| K (Invention) | 100 | 5 | 90 | 4 |
| L (Invention) | 100 | 5 | 95 | 5 |

Note:
*The values are relative values of the reciprocal of an exposure dose which affords blackening (density) of 1.5.
**The dot quality was visually evaluated using a scale of 5 grades, from "1" indicating the worst to "5" indicating the best.

As a dot plate for producing printing plates, the grades "5" and "4" mean practical dot quality for general use, "3" means practical when high quality dot quality is not necessary, and "2" and "1" mean dot quality that is too poor to be practically used.

As is apparent from the results shown in Table 1 above, the fresh Developers A to J show equal sensitivity and dot quality, but after development-processing of 200 exposed films, Developer A (Comparison) shows great reductions in sensitivity and dot quality. On the other hand, only relatively small reductions in sensitivity and dot quality were observed with Developers B to L according to the present invention.

While the invention has been described in detail and with reference to specific embodiments thereof, it will be apparent to one skilled in the art that various changes and modifications can be made therein without departing from the spirit and scope thereof.

What is claimed is:

1. A method for developing an imagewise exposed negative silver halide photographic light-sensitive material in the presence of a hydrazine derivative, comprising treating the material with a developer containing at least components (a) a developing agent, (b) not less than 0.25 mol/liter of a sulfite preservative, and (c) not less than 0.1 mol/liter of a compound having an acid dissociation constant of from $1\times10^{-11}$ to $3\times10^{-13}$, selected from:

the group consisting of saccharides represented by formulae (I) and (II)

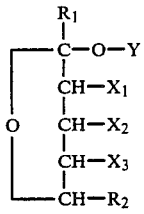

(I)

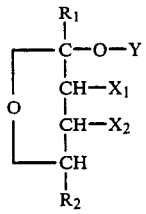

(II)

wherein $X_1$, $X_2$ and $X_3$, which may be the same or different, each represents a hydrogen atom, a hydroxy group, an amino group, a halogen atom, an acyloxy group, an alkoxy group, an acylamino group, or a phosphoryloxy group; $R_1$ and $R_2$, which may be the same or different, each represents a hydrogen atom, an alkyl group, a substituted alkyl group, or a carboxyl group; Y represents a hydrogen atom, an acyl group, an alkoxycarbonyl group, a carbamoyl group, or an alkyl group; and when $X_1$, $X_2$, $X_3$, $R_1$, $R_2$ and Y all represent a hydroxy group, a 5- or 6-membered ring may be formed by an ether-linkage formation between two hydroxy groups of $X_1$, $X_2$, $X_3$, $R_1$, $R_2$ and Y or by an acetal formation of said two hydroxy groups and a carbonyl compound, an oxime represented by formula (III)

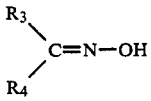

(III)

wherein $R_3$ and $R_4$, which may be the same or different, each represents a hydrogen atom, a substituted or unsubstituted alkyl group, a substituted or unsubstituted aryl group, an acyl group, or a heterocyclic ring; or $R_3$ and $R_4$ together form a 5- or 6-membered ring;

phenols represented by formula (IV)

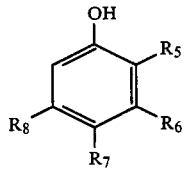

(IV)

wherein $R_5$, $R_6$, $R_7$ and $R_8$, which may be the same or different; each represents a hydrogen atom, an amino group, a carobxyl group, a sulfonic acid group, a substituted or unsubstituted alkyl group having from 1 to 4 carbon atoms, or a substituted or unsubstituted alkoxy group; and fluorinated alcohols represented by formula (V)

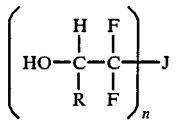

(V)

wherein R represents a hydrogen atom, a substituted or unsubstituted alkyl group, a substituted or unsubstituted cycloalkyl group or a substituted or unsubstituted aryl group; n represents 1 or 2; and J represents a hydrogen atom, a fluorine atom, a substituted or unsubstituted alkyl group, a substituted or unsubstituted cycloalkyl group, a substituted or unsubstituted aryl group or a substituted or unsubstituted aralkyl group when n is 1, or J represents a substituted or unsubstituted alkylene group, a substituted or unsubstituted cycloalkyl group, a substituted or unsubstituted arylene group, or a substituted or unsubstituted aralkylene group when n is 2.

2. A method as in claim 1, wherein component (a) is a combination of at least one dihydroxybenzene compound and at least one 1-phenyl-3-pyrazolidone compound.

3. A method as in claim 2, wherein said dihydroxybenzene compound is hydroquinone.

4. A method as in claim 1, wherein component (a) is present in an amount of from 0.05 mol/liter to 0.8 mol/liter.

5. A method as in claim 2, wherein said dihydroxybenzene compound and 1-phenyl-3-pyrazolidone compound are present in amounts of from 0.05 mol/liter to 0.5 mol/liter and 0.06 mol/liter or less, respectively.

6. A method as in claim 1, wherein component (b) is present in an amount of from 0.3 mol/liter to 1.2 mol/liter.

7. A method as in claim 1, wherein in formulae (I) and (II), $X_1$, $X_2$, and $X_3$ each represents a hydrogen atom or a hydroxy group; $R_1$ or $R_2$ each represents a hydrogen atom, a hydroxymethyl group, a 1,2-dihydroxyethyl group or a carboxyl group; and Y represents a hydrogen atom;

in formula (III), the alkyl group as represented by $R_3$ or $R_4$ contains from 1 to 18 carbon atoms; and in formula (V), R represents a hydrogen atom or a fluorine-substituted alkyl group; and J represents a hydrogen atom, a fluorine atom or a fluorine-substituted alkyl group when n is 1, or J represents a fluorine-substituted alkylene group when n is 2.

8. A method as in claim 7, wherein, in formulae (I) and (II), $X_1$, $X_2$ and $X_3$ each represents a hydroxy group; and $R_1$ and $R_2$ each represents a hydrogen atom, a hydroxymethyl group, or a 1,2-dihydroxyethyl group; and in formula (V), the total carbon atom number is 6 or less per hydrophilic group.

9. A method as in claim 1, wherein component (c) is selected from the group consisting of saccharides of formulae (I) and (II), oximes of formula (II), and fluorinated alcohols of formula (V).

10. A method as in claim 1, wherein component (c) is selected from the saccharides of formulae (I) and (II).

11. A method as in claim 1, wherein component (c) is present in an amount of from 0.2 mol/liter to 1 mol/liter.

12. A method as in claim 1, wherein the hydrazine derivative is represented by formula (VI)

$$R^1—NHNH—G—R^2 \quad (VI)$$

wherein $R^1$ represents an aliphatic group or an aromatic group; $R^2$ represents a hydrogen atom, a substituted or unsubstituted alkyl group, a substituted or unsubstituted aryl group, a substituted or unsubstituted alkoxy group or a substituted or unsubstituted aryloxy group; and B represents a carbonyl group, a sulfonyl group, a sulfoxy group, a phosphoryl group, or an N-substituted or unsubstituted imino group.

13. A method as in claim 12, wherein $R^1$ represents a substituted or unsubstituted aryl group; $R^2$ represents a hydrogen atom; and G represents a carbonyl group.

14. A method as in claim 1, wherein said hydrazine derivative is present in an emulsion layer of the light-sensitive material or a hydrophilic colloidal layer which is adjacent to the emulsion layer in an amount of from $1\times10^{-6}$ to $5\times10^{<2}$ mol per mol of silver.

15. A method as in claim 14, wherein said hydrazine derivative is present in an amount of from $1\times10^{-5}$ to $2\times10^{-2}$ mol per mol of silver.

16. A method as in claim 1, wherein component (a) is a combination of at least one dihydroxybenzene compound and at least one 1-phenyl-3-pyrazolidone compound, and component (b) is present in an amount of from 0.3 mol/liter to 1.2 mol/liter.

17. A method as in claim 16, wherein said dihydroxybenzene compound is hydroquinone.

18. A method as in claim 16, wherein component (c) is selected from the saccharides of formulae (I) and (II).

19. A method as in claim 18, wherein component (c) is present in an amount of from 0.2 mol/liter to 1 mol/liter.

* * * * *